United States Patent [19]

Hochmuth

[11] 3,946,566

[45] Mar. 30, 1976

[54] TURBINE START-UP SYSTEM

[75] Inventor: Frank William Hochmuth, Hudson, Canada

[73] Assignee: Combustion Engineering, Inc., Windsor, Conn.

[22] Filed: Dec. 16, 1974

[21] Appl. No.: 533,108

[52] U.S. Cl. ..... 60/646; 122/479 R; 122/479 S

[51] Int. Cl.[2] ..... F01K 13/02

[58] Field of Search ..... 122/479 R, 479 S; 60/660–667, 646, 656

[56] References Cited

UNITED STATES PATENTS

| | | | |
|---|---|---|---|
| 3,205,664 | 9/1965 | Nettel | 60/646 |
| 3,264,826 | 8/1966 | Kane et al. | 60/646 |

*Primary Examiner*—Allen M. Ostrager
*Attorney, Agent, or Firm*—Robert L. Olson

[57] ABSTRACT

Method and apparatus are described that are operative to elevate the temperature of superheated vapor delivered to a turbine, especially during startup of a power plant. A bypass circuit containing a heat exchanger is interposed in the main steam generator evaporative flow circuit whereby regulated amounts of heat are extracted from the plant operating fluid thereby subcooling the same prior to its passage to the evaporator section of the unit. Reduced amounts of steam are thus produced in the evaporator section for a given amount of heat input to the unit and a concomitant increase realized in the temperature to which the steam passed to the superheater is heated.

Economies as well as operational advantages are achieved by the production in the heat exchanger of low pressure steam that is usable in the plant to augment steam flow to the low pressure section of the turbine, for soot blowing purposes, and/or for other low pressure steam needs during startup and normal operation of the plant.

17 Claims, 1 Drawing Figure

TURBINE START-UP SYSTEM

BACKGROUND OF THE INVENTION

The present invention relates to steam generators of the kind utilized in power plants and having steam superheating facilities. More particularly, the invention involves method and apparatus for regulating superheated steam temperatures of the steam generator especially during startup of the unit.

In the operation of a power plant system some steam generators are arranged to accommodate the base loading of the system while others satisfy fluctuating loads such as may be attendant with nightly or weekend needs of the system. Steam generators which are base loaded are adapted for substantially continuous, uniform operation while those that are accommodating the fluctuating portion of the system demand must be designed for cycling service. This latter type of operation subjects the steam generator and turbine to significant stresses, induced primarily by the temperature differences between components that are caused by cyclic operation.

It is known that cyclic stresses of this type can be ameliorated by limiting the temperature differences that result from cycling service of the unit. Superheating steam generators in the past have been operated in a fashion and have incorporated means to so limit steam temperature differences. Such means have involved supplementary fluid circuits that bypass some of the main operating fluid around the superheater, discharging the same to the condenser. Others incorporate means for venting the steam drum, while still others involve means for blowing down the evaporator. In all of the above instances the quantity of steam passed to the superheater is reduced thereby resulting in increased steam temperatures at the superheater outlet. Such steam temperatures, however, are increased at the cost of significant amounts of working fluid and the heat contained therein being rejected from the system thereby reducing the operational efficiency of the plant.

It is to the improvement, therefore, of steam generator flow systems and their methods of operation that the present invention is directed.

SUMMARY OF THE INVENTION

According to the present invention a power plant including a high pressure fossil fuel fired steam generator having evaporative heating surface and a superheater exposed to high temperature combustion gases flowing in heat transfer relation therewith is provided with apparatus and a method of operating the same for regulating the temperature of steam delivered from the superheater to the turbine. The described means is particularly adapted to increase the superheater outlet temperature in instances, such as cyclic operation of the steam generator, when steam superheat and/or reheat temperatures may have a tendency of being above or below that of the metal forming the component parts of the system thus to impose thermal stresses thereon.

The invention comprises, in essence, the provision of a fluid bypass circuit superimposed upon the main steam generator flow circuit whereby controlled amounts of high pressure operating fluid are diverted therefrom. The bypass circuit contains a heat exchanger in which heat is extracted from the diverted operating fluid prior to returning the same in a subcooled condition to the main vapor generating flow circuit for circulation through the evaporative heating surface therein. As a result or subcooling, therefore, the operating fluid, when subjected to a given amount of heat in passing through the evaporative heating surface, produces a reduced amount of steam for passage through the superheater. Accordingly, by circulating reduced amounts of steam through the superheater the same amount of heat available for heating the fluid passed therethrough will result in an increased steam superheat temperature.

The invention contemplates generating low pressure steam in the bypass heat exchanger, which steam can be passed directly to the condenser or, preferably, in the interest of conserving the heat extracted from the diverted operating fluid, the low pressure steam can be introduced to the low pressure cylinder of the turbine to augment the vapor flow therein. Alternatively, this low pressure steam can be utilized for tempering reheat system prior to its admission to the intermediate pressure cylinder when the temperature of the reheat steam may be excessive.

The invention further contemplates as yet another alternative, utilization of the low pressure heat exchanger for the generation of auxiliary steam for soot blowing or fuel atomizing purposes. In these instances a secondary, low pressure liquid having reduced purity characteristics as compared with the liquid required for flow through the main steam generator flow circuit can be utilized due to the less stringent requirements of the low pressure heat exchanger.

For a better understanding of the invention, its operating advantages and the specific objects obtained by its use, reference should be made to the accompanying drawing and description which relate to a preferred embodiment of the invention.

DESCRIPTION OF THE DRAWING

The single drawing FIGURE depicts a schematic flow diagram of a steam operated power plant utilizing temperature regulating method and apparatus of the present invention.

DESCRIPTION OF THE PREFERRED EMBODIMENT

Figure 1:
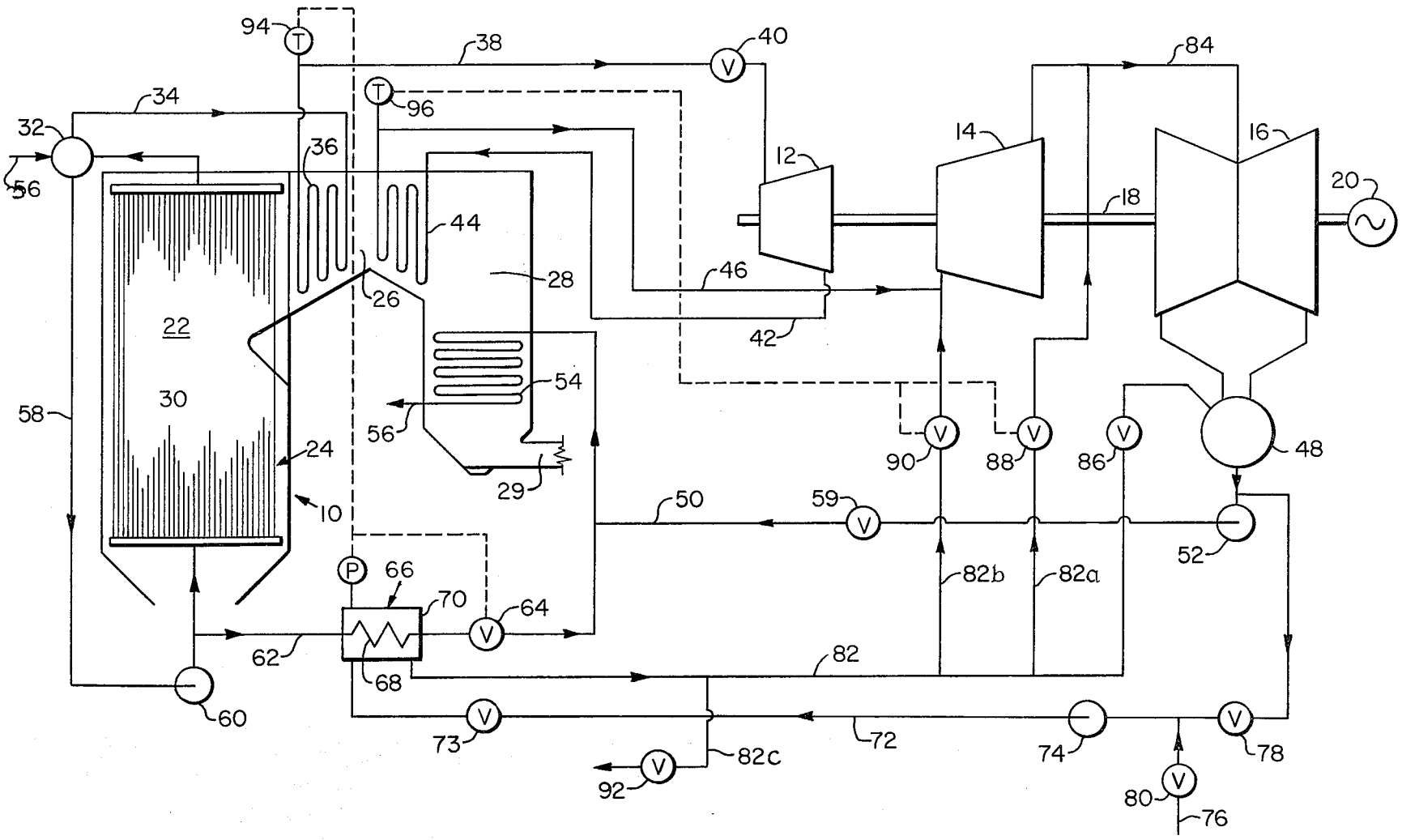

The drawing depicts a power plant system comprising a steam generator 10 that produced high temperature, high pressure steam for delivery to the respective sections 12, 14 and 16 of a turbine set which is drivingly connected through turbine shaft 18 to an electrical generator 20. The steam generator 10 comprises a furnace compartment 22 within which fuel burners 24 are operably disposed to produce combustion gases that flow through the furnace compartment and thence through the convection and rear pass sections, 26 and 28 respectively, of the unit before being discharged from outlet 29 to a stack (not shown). As is well known, additional heat recovery and gas handling equipment (not shown) may be interposed in the combustion gas flow stream between outlet 29 and the stack.

The walls of the unit are lined with fluid-conducting tubes 30 within which water is evaporated and a mixture of steam and water subsequently passed to a mixture-separating drum 32. The steam fraction of the mixture is conducted from the drum 32 through line 34 to a superheater 36 here shown as being located in the convection section 26 of the unit where it is heated to an elevated temperature prior to being supplied via line 38 containing throttle valve 40 to the high pressure section 12 of the turbine set. Upon discharge from section 12 of the turbine, the steam is returned through line 42 to the steam generator 10 for reheating in the reheater 44 and then passed via line 46 to the intermediate and low pressure sections, 14 and 16 respectively, of the turbine. The spent steam discharged from the low pressure turbine section 16 is condensed in condenser 48 and returned by means of return line 50 containing high pressure pump 52 to the unit where it is passed first through the economizer 54 located in the rear pass 28 and then through line 56 to the drum 32 where it combines with the water fraction of the mixture for circulation through conduit 58 which supplies the wall-lining tubes 30. Main feed valve 59 is disposed in line 50 regulating liquid flow to the economizer 54. A circulating pump 60 may be contained in line 58 to induce flow of fluid through the tubes 30.

According to the invention a bypass line 62 is operatively disposed in the steam generator fluid circuit having its inlet end connected to the conduit 58 intermediate the circulating pump 60 and the upstream ends of the wall-lining tubes 30. At its outlet end the bypass line 62 connects with line 50 upstream of the economizer 54. The bypass line 62 contains a flow regulating valve 64 arranged to pass regulated amounts of operating fluid from the main steam generator fluid circuit. A heat exchanger, indicated as 66, is disposed in the bypass line 62 and is operative to extract heat from the fluid passed through the bypass line in controlled amounts so as to alter the amount of steam generated in the evaporative region of the unit and concomitantly the temperature of the steam at the superheater outlet as hereinafter more fully described.

The heat exchanger 66 can be any of a variety of well-known constructions that are effective to indirectly transfer heat between two flowing media. In the illustrated arrangement the heat exchanger 66 is depicted as a shell and coil heat exchanger containing a coil 68 interposed in the bypass line 62 through which the fluid extracted from the main steam generator flow circuit is passed. A shell 70 encloses the coil and passes the cooling medium which is supplied thereto through line 72 containing liquid level regulator valve 73. The cooling medium is a low pressure fluid which is caused to flow under the influence of a low pressure feed pump 74 and may emanate, as when high purity liquid is required, from the condenser 48. When low purity liquid may be employed the cooling medium can be obtained from an independent source (not shown) through line 76. Operator valves 78 and 80 are disposed in lines 72 and 76 respectively for the selective passing of cooling fluid from one of the two available sources.

A fluid discharge line 82 from the heat exchanger 66 is operative to conduct low pressure, saturated steam produced in the heat exchanger to any one of several possible points of use in the system. In the illustrated arrangement the line 82 connects between the heat exchanger 66 and the condenser 48. Lines 82a and 82b that emanate from line 82 connect respectively with a crossover line 84 to the low pressure section 16 of the turbine, and to the reheater outlet line 46. Operating valves 86, 88 and 90 in the respective lines permit selective discharge of the low pressure steam to the several points of use. A third line, indicated as **82*c*, and containing valve 92 emanates from line 82** and serves to conduct low pressure steam to any of several plant auxiliaries such as for example the furnace soot blowers or the fuel atomizers.

The operation of the herein described power plant system is as follows. As is well known, vaporizable liquid is supplied to the tubes 30 of the steam generator 10 via line 58 and circulating pump 60 while at the same time fuel is burned by burners 24 to produce high temperature combustion gases that flow through the respective sections 22, 26 and 28 of the steam generator to the stack (not shown). Under certain operating conditions steam produced in the tubes 30 and heated in the superheater 36 and reheater 44 is drivingly supplied to the respective sections 12, 14 and 16 of the turbine set. If the temperature of the steam supplied to the turbine set is too low to match turbine metal temperatures then valve 64 is actuated in response to temperature sensor 94 to pass a regulated amount of operating fluid from the conduit 58 through the bypass line 62 containing the heat exchanger 66. Simultaneously therewith, a controlled amount of cooling medium in the form of low pressure liquid from the condenser 48, or from a separate source, is passed through line 72 to subcool the extracted operating fluid. The subcooled fluid is then returned to the economizer 54 in the main fluid circuit where its effect is to reduce the amount of steam generated in the tubes 30 and concomitantly the amount of steam passed to the superheater 36 through line 34. Because a reduced amount of steam is passed to the superheater its temperature will be commensurately raised to a higher level as long as the firing rate of the burners remains the same. The amount of required steam temperature increase establishes the amount of main operating fluid diverted through bypass line 62 and heat exchanger 66.

The effect produced by the described arrangement is substantially the same as bypassing part of the steam from the drum 32 around the superheater 36, venting the drum to atmosphere, or blowing down the water wall tubes 30 as has been done in the past. An improvement in operational efficiency of the system is obtained, however, as a result of the described apparatus because the heat extracted from the main operating fluid in the heat exchanger 66 operates to produce steam, albeit at a lower pressure than that in the main fluid circuit. The low pressure steam is discharged from the heat exchanger 66 through line 82 and can be passed directly to the condenser 48. More desirably, however, this low pressure steam is passed via lines **82*a* or 82*b* in amounts regulated by valves 88 or 90 to the low pressure section 16 of the turbine set to augment the main steam supply thereto or to the reheater discharge line 46 thereby tempering the reheat steam supplied to the intermediate pressure section 14 of the turbine set in the event that the temperature of this steam is greater than that which can be accommodated by the turbine as determined by its casing metal temperatures. As shown, control of the respective regulator valves 88 or 90 can be effected for the above described purposes in response to temperatures sensed by the sensor 96.**

In the practice of the above mode of operation, where the low pressure steam produced in the heat exchanger 66 is injected into the main steam circuit it is imperative that the cooling medium supplied to the heat exchanger be of acceptably high purity. Therefore, in such instance the flow regulator valve 78 in line 72 is open and valve 80 in line 76 closed to pass fluid from the condenser 48.

Alternatively, the described system enables the use of a lower purity cooling medium in the heat exchanger 66, such as, for example in instances where the steam produced in the heat exchanger, instead of being injected into the main steam circuit, is more desirably utilized for soot blowing or fuel atomizing purposes. In these instances the valves 86, 88 and 90 in lines 82, 82*a* and 82*b* are closed and valve 92 in line 82*c* opened. At the same time valve 78 is closed and valve 80 in line 76 opened to supply a lower purity cooling medium to the heat exchanger 66. Thus by enabling the use of lower purity steam for soot blowing or fuel atomizing purposes the invention advantageously reduces the water purification costs of the plant. Moreover, it will be obvious that the piping and ancillary components utilized in the practice of the invention are subjected only to low pressures and temperatures thereby enabling their incorporation in a plant at minimal cost.

It will be understood that various changes in the details, materials and arrangements of parts which have been herein described and illustrated in order to explain the nature of the invention, may be made by those skilled in the art within the principle and scope of the invention as expressed in the appendid claims.

What is claimed is:

1. In a power plant system comprising turbine means for driving a prime mover and a vapor generator for supplying high pressure, superheated vapor to said turbine means by the transfer of heat from the heat input to said vapor generator, said vapor generator including a flow circuit having an evaporator for converting liquid to saturated vapor, a boiler drum operatively connected to said evaporator for separating liquid from the saturated vapor delivered to said drum and for recirculating the separated liquid through said evaporator means for supplying liquid to be vaporized to said vapor drum and a superheater operatively connected to said boiler drum for heating the vapor separated therein, the method of increasing the temperature of vapor heated in said superheater under the influence of a relatively constant heat input to said vapor generator comprising:

a. diverting a regulated portion of the liquid from said vapor generator flow circuit upstream of said evaporator;

b. extracting a regulated amount of heat from said diverted liquid portion to subcool the same; and c. mixing said subcooled diverted liquid portion with the liquid admitted to said boiler drum whereby the amount of vapor passed to said superheater is reduced.

2. The method recited in claim 1 in which heat is extracted from said diverted liquid portion by transfering the same to liquid flowing in a separate fluid circuit.

3. The method recited in claim 2 in which the liquid in said separate fluid circuit is at a lower pressure than that of said vapor generator flow circuit and is vaporized by the transfer of heat from said diverted liquid portion.

4. The method recited in claim 3 including the step of passing the vaporized liquid of said separate flow circuit to a lower pressure stage of said turbine means to do useful work therein.

5. The method recited in claim 3 in which said vapor generator includes a reheater interposed in the power plant system intermediate separate stages of said turbine means and including the step of passing the vaporized liquid of said separate flow circuit into mixed relation with the reheated vapor delivered to the lower pressure stage of said turbine means for tempering the same.

6. The method recited in claim 3 in which said power plant includes vapor operated auxiliary equipment and including the step of passing the vaporized liquid of said separate flow circuit to said auxiliary equipment for operating the same.

7. The method recited in claim 1 including the step of regulating the flow of diverted liquid in response to deviations in the temperature of vapor exiting said superheater.

8. The method recited in claim 5 including the step of regulating the amount of vaporized liquid passed into mixing relation with said reheated vapor in response to deviations in the temperature of vapor exiting said reheater.

9. In a power plant including a vapor generator having a fluid flow circuit in which water is evaporated in an evaporator section and the resulting vapor heated in a superheater section, said evaporator and superheater sections being heated by combustion gas flowing serially thereover, apparatus for increasing the temperature of the vapor discharged from said superheater section while maintaining the heat input from said combustion gases substantially constant comprising:

a. a bypass circuit for diverting at least a portion of the operating fluid flowing through said vapor generator fluid flow circuit, said bypass circuit having an inlet end and an outlet end, said bypass circuit communicating with said fluid flow circuit at both its inlet and outlet ends upstream in the fluid flow sense of said evaporator section; and b. means operative in said bypass circuit for extracting heat from said diverted fluid prior to admitting it to said evaporator section.

10. Apparatus as recited in claim 9 in which heat is extracted in an indirect transfer heat exchanger and including means for supplying cooling medium to said heat exchanger, said cooling medium being fluid at a lower pressure than that of said operating fluid.

11. Apparatus as recited in claim 10 in which said cooling medium is condensed fluid from said vapor generator fluid flow circuit.

12. Apparatus as recited in claim 10 including means for supplying cooling medium to said heat exchanger from a source external of said vapor generator fluid flow circuit.

13. Apparatus as recited in claim 10 in which said cooling medium is evaporated in said heat exchanger and including conducting means for conducting said evaporated cooling medium to a point of use in said power plant.

14. Apparatus as recited in claim 10 wherein said power plant includes a turbine set having a low pressure stage and in which said conducting means supplies evaporated cooling medium to the inlet of said low pressure turbine stage.

15. Apparatus as recited in claim 10 wherein said power plant includes a turbine stage operated by reheat vapor and in which said conductng means supplies evaporated cooling medium to said turbine stage for tempering the reheat vapor admitted thereto.

16. Apparatus as recited in claim 10 wherein said vapor generator includes vapor operated auxiliaries and in which said conducting means supplies evaporated cooling medium to said auxiliaries for operating the same.

17. Apparatus as recited in claim 12 in which said vapor generator includes vapor operated auxiliaries and in which said conducting means supplies evaporated cooling medium to said auxiliaries for operating the same.

* * * * *